US009734759B2

(12) United States Patent
Kim et al.

(10) Patent No.: US 9,734,759 B2
(45) Date of Patent: Aug. 15, 2017

(54) ORGANIC LIGHT-EMITTING DIODE DISPLAY

(71) Applicant: Samsung Display Co., Ltd., Yongin-si, Gyeonggi-do (KR)

(72) Inventors: Kwang-Min Kim, Seoul (KR); Seung-Kyu Lee, Asan-si (KR)

(73) Assignee: Samsung Display Co., Ltd., Gyeonggi-Do (KR)

( * ) Notice: Subject to any disclaimer, the term of this patent is extended or adjusted under 35 U.S.C. 154(b) by 0 days.

(21) Appl. No.: 14/928,843

(22) Filed: Oct. 30, 2015

(65) Prior Publication Data

US 2016/0321990 A1 Nov. 3, 2016

(30) Foreign Application Priority Data

Apr. 30, 2015 (KR) ..... 10-2015-0062071

(51) Int. Cl.
*G09G 3/3233* (2016.01)
*G09G 3/3266* (2016.01)

(52) U.S. Cl.
CPC ..... *G09G 3/3233* (2013.01); *G09G 3/3266* (2013.01); *G09G 2300/0413* (2013.01); *G09G 2300/0819* (2013.01); *G09G 2300/0842* (2013.01); *G09G 2300/0861* (2013.01); *G09G 2310/0262* (2013.01); *G09G 2320/0233* (2013.01); *G09G 2320/0238* (2013.01); *G09G 2320/045* (2013.01)

(58) Field of Classification Search
None
See application file for complete search history.

(56) References Cited

U.S. PATENT DOCUMENTS 8,547,372 B2 10/2013 Chung et al.
2012/0033148 A1* 2/2012 Yang ..... G02F 1/134309 349/39
2012/0293467 A1* 11/2012 Lee ..... G09G 3/3677 345/204
2014/0098083 A1* 4/2014 Lee ..... G09G 3/3291 345/213

(Continued)

FOREIGN PATENT DOCUMENTS

JP 2010-170009 A 8/2010
KR 10-2014-0046113 A 4/2014
KR 10-2014-0119584 A 10/2014

*Primary Examiner* — Christopher Kohlman
(74) *Attorney, Agent, or Firm* — Knobbe Martens Olson & Bear LLP

(57) ABSTRACT

An organic light-emitting diode display is disclosed. In one aspect, the display includes a display panel including a plurality of display pixels and a plurality of dummy pixels. The display also includes a scan driver including a plurality of first stages configured to sequentially supply a plurality of scan signals to the scan lines and a plurality of second stages configured to sequentially supply a plurality of scan signals to the dummy scan lines. The display also includes a data driver configured to provide corresponding data signals to the data lines, wherein each of the scan signals includes at least one first pulse to be applied as a bias voltage to a driving transistor of each of the display pixels and the dummy pixels and a second pulse to be applied as the corresponding data signal to the driving transistor.

19 Claims, 6 Drawing Sheets

(56) References Cited

U.S. PATENT DOCUMENTS

2014/0292827 A1* 10/2014 Kang ..... G09G 3/20
345/690
2015/0170562 A1* 6/2015 In ..... G09G 3/3258
345/80

* cited by examiner

ORGANIC LIGHT-EMITTING DIODE DISPLAY

CROSS-REFERENCE TO RELATED APPLICATION

This application claims priority to and the benefit of Korean Patent Application No. 10-2015-0062071 filed in the Korean Intellectual Property Office on Apr. 30, 2015, the entire contents of which are incorporated herein by reference.

BACKGROUND

Field

The described technology generally relates to an organic light-emitting diode display.

Description of the Related Technology

An organic light-emitting diode (OLED) includes two electrodes and an interposed organic emission layer. Electrons injected from one electrode and holes injected from another electrode are combined with each other in the organic emission layer to form excitons, and light is emitted by emission of energy by the excitons.

An OLED display includes a matrix of pixels, and in each pixel, a plurality of transistors and at least one capacitor for driving the OLED are formed. The transistors basically include a switching transistor and a driving transistor.

Typically, each pixel of an OLED display generates a black gray and then represents a white gray, light having a luminance lower than a desired luminance is generated for a period of approximately two frames due to response rate deterioration. In the case in which the OLED display generates a moving screen such as a scroll screen, the response rate deterioration phenomenon of the pixel causes a problem that each pixel may not display an image having a desired luminance in response to a gray, such that luminance uniformity and image quality of a moving picture are deteriorated. The response rate deterioration in the pixel is due to hysteresis of the driving transistor. That is, a threshold voltage of the driving transistor is shifted in response to a voltage applied to the driving transistor of the pixel in a previous frame period, and the pixel may not generate light having a desired luminance in a current frame due to the shift of the threshold voltage.

The above information disclosed in this Background section is only for enhancement of understanding of the background of the described technology and therefore it can contain information that does not constitute the prior art that is already known in this country to a person of ordinary skill in the art.

SUMMARY OF CERTAIN INVENTIVE ASPECTS

One inventive aspect relates to an OLED display that can improve deterioration of image quality of a moving picture due to hysteresis characteristics of a driving transistor.

Another aspect is an OLED display including: a display panel including a plurality of pixels formed at intersection portions between a plurality of scan lines and a plurality of data lines and a plurality of dummy pixels formed at intersection portions between a plurality of dummy scan lines and the plurality of data lines; a scan driver including a plurality of first stages sequentially supplying a plurality of scan signals to the plurality of scan lines and a plurality of second stages sequentially supplying a plurality of scan signals to the plurality of dummy scan lines; and a data driver supplying corresponding data signals to the plurality of data lines, wherein each of scan signals supplied to the plurality of pixels and the plurality of dummy pixels includes at least one first pulse for applying a bias voltage to a driving transistor of each of the plurality of pixels and the plurality of dummy pixels and a second pulse for applying the corresponding data signal to the driving transistor, and the plurality of dummy pixels are formed at both sides based on the plurality of pixels in a state in which the plurality of dummy pixels are divided.

Another aspect is an organic light-emitting diode (OLED) display, comprising: a display panel including i) a plurality of display pixels formed at intersection areas of a plurality of scan lines and a plurality of data lines and ii) a plurality of dummy pixels formed at intersection areas of a plurality of dummy scan lines and the data lines; a scan driver including a plurality of first stages configured to sequentially supply a plurality of scan signals to the scan lines and a plurality of second stages configured to sequentially supply a plurality of scan signals to the dummy scan lines; and a data driver configured to provide corresponding data signals to the data lines, wherein each of the scan signals includes i) at least one first pulse to be applied as a bias voltage to a driving transistor of each of the display pixels and the dummy pixels and ii) a second pulse to be applied as the corresponding data signal to the driving transistor, and wherein the dummy pixels are formed above and below the display pixels in the display panel.

In the above OLED display, the second stages are electrically connected to the first stages and configured to sequentially supply the scan signals to the respective dummy scan lines after the first stages supply the scan signals.

In the above OLED display, the first stages comprise a final stage configured to drive a first one of the second stages.

In the above OLED display, the second stages include first and second stage groups formed above and below the first stages.

In the above OLED display, the display panel includes at least one carry out line electrically connected to the first and second stage groups.

The above OLED display further comprises a controller configured to generate a scan control signal to control the scan driver and a data control signal to control the data driver.

In the above OLED display, any one of the first and second stage groups is configured to receive a start signal input from the controller.

In the above OLED display, a period in which the second pulse is output to a first one of the scan lines overlaps a period in which the first pulse is output to at least one of the other scan lines.

In the above OLED display, a first group of the display pixels connected to the first scan line share capacitances with a second group of the display pixels connected to the at least one of the other scan lines in the period in which the second pulse is output to the first scan line.

In the above OLED display, each of the display pixels includes: a switching transistor electrically connected to a corresponding scan line and a corresponding data line and including a drain electrode configured to i) output the bias voltage during a period in which the first pulse is input to the corresponding scan line and ii) output a corresponding data signal during a period in which the second pulse is input to the corresponding scan line; the driving transistor including a source electrode electrically connected to the drain electrode of the switching transistor; a storage capacitor including a first electrode electrically connected to a gate electrode of the driving transistor and a second electrode electrically connected to a driving voltage line to which a driving voltage is input; and an OLED electrically connected to the drain electrode of the driving transistor.

Another aspect is an organic light-emitting diode (OLED) display, comprising: a display panel including a plurality of display pixels arranged in a plurality of rows and a plurality of dummy pixels arranged in a plurality of rows above and below the display pixels; and a scan driver including i) a plurality of first stages configured to sequentially supply a plurality of scan signals to a plurality of dummy scan lines and ii) a plurality of second stages formed above and below the first stages and configured to sequentially supply a plurality of scan signals to the dummy scan lines, wherein each of the scan signals includes i) at least one first pulse configured to be applied as a bias voltage to the display pixels and the dummy pixels and ii) a second pulse configured to be applied as a data signal to the display and dummy pixels.

In the above OLED display, the scan driver has an upper side and a lower side, wherein the second stages include a plurality of upper second stages formed in the upper side and a plurality of lower second stages formed in the lower side.

In the above OLED display, the upper second stages are formed above the first stages, wherein the lower second stages are formed below the first stages.

In the above OLED display, the upper second stages include two stages, wherein the lower second stages include two stages.

The above OLED display further comprises a controller configured to provide a scan control signal to the scan driver and a scan start signal to the upper second stages.

In the above OLED display, the controller is further configured to provide a vertical start signal to start a scanning process only for the first one of the first stages.

In the above OLED display, the lower second stages are configured to provide a carry out signal to the upper second stages.

In the above OLED display, the scan lines include first to last scan lines, wherein a last one of the first stages is configured to provide two bias voltage pulses to the last scan line and a data voltage.

In the above OLED display, a last one of the second stages is configured to provide two bias voltages and a data voltage to a last one of the dummy scan lines, wherein the time when the data voltage is provided to the last first stage overlaps the time when the first one of the bias voltages is applied to the last dummy scan line.

In the above OLED display, each of the display and dummy pixels includes driving, switching and compensation transistors each including a gate electrode connected to the corresponding scan line or dummy scan line.

According to at least one of the disclosed embodiments, at least one pulse for applying a bias voltage is added to a scan signal, thereby making it possible to improve deterioration of image quality of a moving picture due to hysteresis characteristics of a driving transistor.

In addition, dummy pixels are added, thereby making it possible to improve a horizontal line appearance phenomenon generated due to the addition of the pulse for applying the bias voltage.

Further, the dummy pixels are formed at an upper end and a lower end of a display area in a state in which they are divided, thereby making it possible to minimize a dead space.

DETAILED DESCRIPTION OF CERTAIN INVENTIVE EMBODIMENTS

Figure 1:
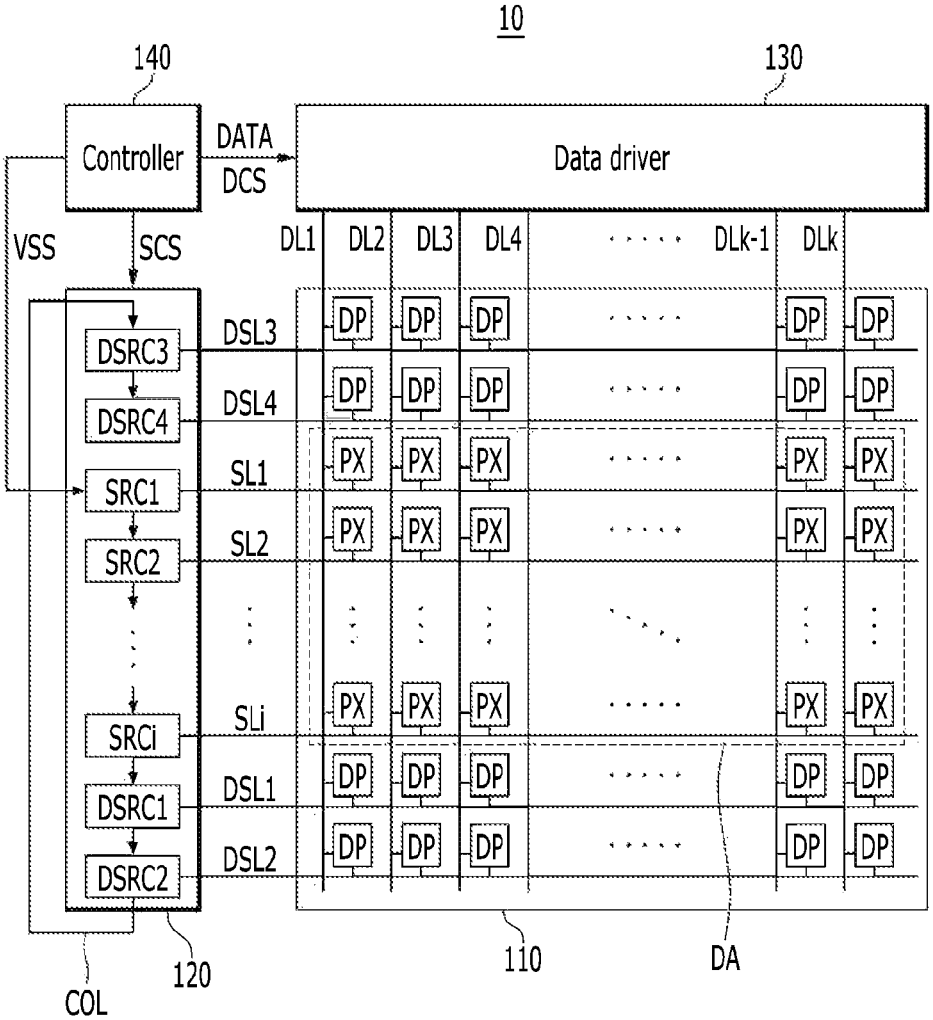
FIG. 1 is a schematic block diagram of an OLED display according to an exemplary embodiment.

Hereinafter, several exemplary embodiments will be described in detail with reference to the accompanying drawings so that those skilled in the art to which the described technology pertains can easily practice the described technology. However, the described technology can be implemented in various different forms and is not limited to exemplary embodiments provided herein.

Portions unrelated to the description will be omitted in order to obviously describe the described technology, and similar components will be denoted by the same reference numerals throughout the present specification.

In addition, since sizes and thicknesses of the respective components shown in the accompanying drawings are arbitrarily shown for convenience of explanation, the described technology is not necessarily limited to contents shown in the accompanying drawings.

In the drawings, the thickness of layers, films, panels, regions, etc., are exaggerated for clarity. In addition, in the accompanying drawings, thicknesses of some of layers and regions have been exaggerated for convenience of explanation. It will be understood that when an element such as a layer, a film, a region, or a substrate is referred to as being "on" another element, it can be directly on another element or can have an intervening element present therebetween.

In addition, throughout the present specification, unless explicitly described to the contrary, the word "comprise" and variations such as "comprises" or "comprising", will be understood to imply the inclusion of stated elements but not the exclusion of any other elements. In addition, throughout the specification, the word "on" does not necessarily mean that any element is positioned at an upper side based on a gravity direction, but means that any element is positioned above or below a target portion. In this disclosure, the term "substantially" includes the meanings of completely, almost completely or to any significant degree under some applications and in accordance with those skilled in the art. The term "connected" can include an electrical connection.

Hereinafter, an OLED display according to an exemplary embodiment will be described in detail with reference to FIGS. 1 to 6.

FIG. 1 is a schematic block diagram of an OLED display according to an exemplary embodiment. Depending on embodiments, certain elements may be removed from or additional elements may be added to the OLED display 10 illustrated in FIGS. 1 and 6. Furthermore, two or more elements may be combined into a single element, or a single element may be realized as multiple elements. This also applies to the remaining disclosed embodiments.

Referring to FIG. 1, the OLED display 10 includes a display panel 110 including a matrix of pixels (or display pixels) PXs and a plurality of dummy pixels DPs, a scan driver 120, a data driver 130, and a controller 140. The scan driver 120, the data driver 130, and the controller 140 can be formed in separate semiconductor chips, respectively, or be integrated in one semiconductor chip. In addition, the scan driver 120 can also be formed on the same substrate as a substrate on which the display panel 110 is formed.

The display panel 110 has a plurality of scan lines SL1 to SLi formed in a transversal direction (or a horizontal direction) thereon, and has a plurality of data lines DL1 to DLk formed in a longitudinal direction (or a vertical direction) thereon so as to intersect with the scan lines SL1 to SLi. A plurality of pixels PXs arranged approximately in a matrix form are formed at intersection portions between the scan lines SL1 to SLi and the data lines DL1 to DLk. The respective scan lines SL1 to SLi serve to supply scan signals in a unit of pixel PX rows configured of the pixels PXs arranged in the transversal direction (or the horizontal direction). The respective data lines DL1 to DLk serve to supply data signals in a unit of pixel PX columns configured of the plurality of pixels PXs arranged in the longitudinal direction (or the vertical direction).

The display/panel 110 has a plurality of dummy scan lines DSL1 to DSL4 formed thereon so as to be approximately in parallel with the scan lines SL1 to SLi. The dummy scan lines DSL1 to DSL4 are formed to be spaced apart from the scan lines SL1 to SLi by a predetermined distance. In addition, the dummy scan lines DSL are formed to vertically intersect with the data lines DL. A plurality of dummy pixels DPs are formed at intersection portions between the dummy scan lines DSL1 to DSL4 and the data lines DL1 to DLk. The dummy pixels DPs are additional pixels that do not display an image unlike the pixels PXs displaying the image. The dummy pixels DPs can be formed in the same structure (for example, a 7-Tr 1-Cp structure) as that of each pixel PX, and can have a size that is the same as or slightly less than that of each pixel PX.

The dummy pixels DPs are formed in an exterior area of a display area DA in which the pixels PXs are formed. The dummy pixels DPs form a plurality of dummy pixel DP rows arranged in parallel with the pixel PX rows. The dummy pixel DP rows are formed at both sides based on the display area DA. That is, the dummy pixel DP rows are formed at an upper end and a lower end of the display area DA in the state in which they are divided. Therefore, the dummy scan lines DSL1 to DSL4 supplying the scan signals to the respective dummy pixel DP rows are also formed in the exterior area of the display area DA, and are formed at both sides based on the scan lines SL1 to SLi in a state in which they are divided. Meanwhile, although the case in which two dummy pixel DP rows and two dummy scan lines supplying the scan signals to the respective dummy pixel DP rows are formed at the upper end and the lower end based on the display area DA, respectively, has been shown by way of example in FIG. 1, an exemplary embodiment is not limited thereto. For example, two or more dummy pixel DP rows and two or more dummy scan lines are also formed at the upper end and the lower end of the display area DA, respectively, in the display panel 110.

A plurality of light emission control lines supplying light emission control signals, initialization voltage lines supplying initialization voltages, driving voltage lines, supplying a power supply voltage, and the like, can be additionally formed on the display panel 110.

The scan driver 120 generates the scan signals in response to a control of the controller 140. In addition, the scan driver 120 sequentially supplies the scan signals to the display panel 110 through the scan lines SL1 to SLi and the dummy scan lines DSL1 to DSL4.

The scan driver 120 includes a plurality of stages SRC1 to SRCi outputting the scan signals to the respective scan lines SL1 to SLi. The stages SRC1 to SRCi include shift register circuits, respectively, and are dependently connected to each other. The scan driver 120 starts to be driven when a vertical start signal (VSS) is applied to a first stage SRC1 of the stages SRC1 to SRCi, and the other stages SRC2 to SRCi are operated in a sequential driving scheme in which they start to be driven by outputs of front stages. When the respective stages SRC1 to SRCi start to be driven, they output the scan signals to corresponding scan lines SL1 to SLi.

The scan driver 120 further includes a plurality of stages DSRC1 to DSRC4 outputting the scan signals to the respective dummy scan lines DSL. Hereinafter, for convenience of explanation, a state supplying the scan signal to the dummy scan line DSL will be called a dummy stage. The dummy stages DSRC1 to DSRC4 include shift registers, respectively, and are dependently connected to each other.

The dummy stages DSRC1 to DSRC4 are dependently connected to the stages SRC1 to SRCi. The dummy stages DSRC1 to DSRC4 start to be driven when start signals are applied from the stages SRC1 to SRCi thereto. That is, a first dummy stage DSRC1 of the dummy stages DSRC1 to DSRC4 is dependently connected to a final stage SRCi of the stages SRC1 to SRCi, such that it starts to be driven by an output of the final stage SRCi. In addition, the other dummy stages DSRC2 to DSRC4 are operated in a sequential driving scheme in which they start to be driven by outputs of front dummy stages. When the respective dummy stages DSRC1 to DSRC4 start to be driven, they output the scan signals to corresponding dummy scan lines DSL1 to DSL4.

As described above, the dummy pixel DP rows and the dummy scan lines DSL1 to DSL4 supplying the scan signals to the respective dummy pixel DP rows are formed at the upper end and the lower end based on the display area DA in a state in which they are divided. Therefore, the dummy stages DSRC1 to DSRC4 outputting the scan signals to the dummy scan lines DSL1 to DSL4 can also be formed in a state in which they are divided into a dummy stage group outputting the scan signal to the dummy scan lines DSL1 and DSL2 formed at the lower end based on the stages SRC1 to SRCi and a dummy stage group outputting the scan signals to the dummy scan lines DSL3 and DSL4 formed at the upper end based on the stages SRC1 to SRCi.

Therefore, in order to sequentially drive the dummy stages DSRC1 to DSRC4, a carry out line dependently connecting the dummy stage groups formed at the upper end and the lower end in the state in which they are divided to each other can be additionally formed on the display panel 110. In an example of FIG. 1, in order to sequentially drive a third dummy stage DSRC3 formed at the upper end after a second dummy stage DSRC2 formed at the lower end, the display panel 110 includes a carry out line COL connecting an output terminal of the second dummy stage DSRC2 and an input terminal of the third dummy stage DSRC3 to each other.

The scan signals supplied to the respective stages SRC1 to SRCi and the dummy stages DSRC1 to DSRC4 of the scan driver 120 can include at least one pulse for applying a bias voltage to a driving transistor (see reference characters T1 of FIG. 2) of a corresponding pixel PX and a pulse for applying a data signal corresponding to the driving transistor T1. A detailed description for this will be described below.

The data driver 130 supplies the data signals to the pixels PXs and the dummy pixels DPs through the data lines DL1 to DLk. The data driver 130 converts input image data DATA input from the controller 140 and having a gray into a voltage or current form to obtain the data signals corresponding to the respective pixels PXs.

The controller 140 generates a scan control signal (SCS) and a data control signal (DCS) and transfers the scan control signal and the data control signal to the scan driver 120 and the data driver 130, respectively. Therefore, the scan driver 120 sequentially applies the scan signals to the scan lines SL1 to SLi and the dummy scan lines DSL1 to DSL4, and the data driver 130 applies the data signals to the respective pixels PXs and the dummy pixels DPs. In addition, a driving voltage ELVDD, a common voltage ELVSS, a light emission control signal EM, an initialization voltage Vint, a bypass signal BP, and the like, can be applied to the respective pixels PXs and the dummy pixels DPs under a control of the controller 140.

Figure 2:
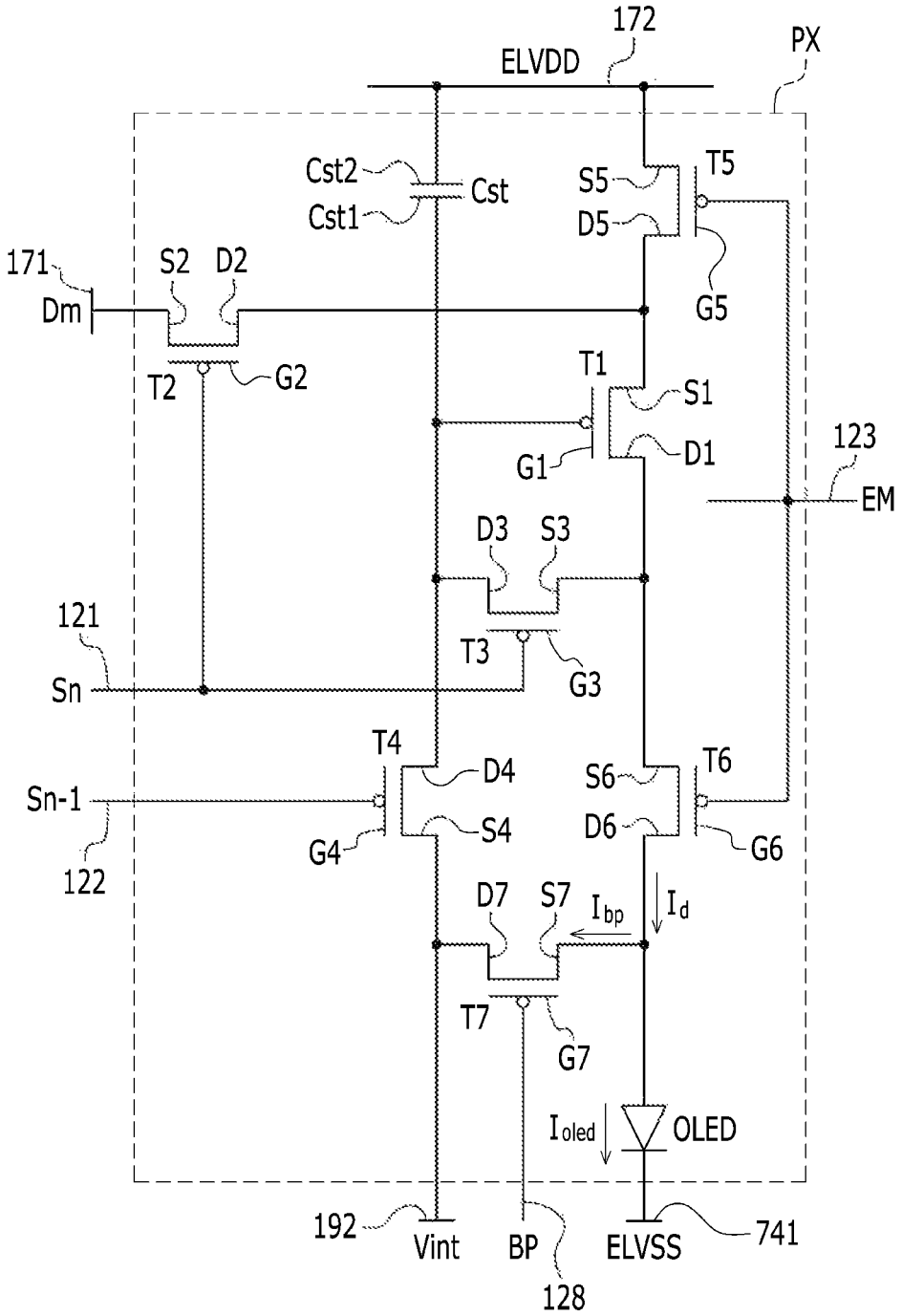
FIG. 2 is an equivalent circuit diagram of one pixel of the OLED display according to an exemplary embodiment.

FIG. 2 is an equivalent circuit diagram of one pixel of the OLED display device according to an exemplary embodiment.

Referring to FIG. 2, one pixel 1 of the OLED display 10 includes a plurality of signal lines 121, 122, 123, 128, 171, 172, and 192, a plurality of transistors T1, T2, T3, T4, T5, T6, and T7 connected to the signal lines, a storage capacitor Cst, and an OLED.

The transistors T1, T2, T3, T4, T5, T6, and T7 include a driving transistor T1, a switching transistor T2, a compensation transistor T3, an initialization transistor T4, an operation control transistor T5, a light emission control transistor T6, and a bypass transistor T7.

The signal lines 121, 122, 123, 128, 171, 172, and 192 include a scan line 121 transferring a scan signal SSn, a front scan line 122 transferring to a front scan signal Sn-1 to the initialization transistor T4, a light emission control line 123 transferring a light emission control signal EM to the operation control transistor T5 and the light emission control transistor T6, a bypass control line 128 transferring a bypass signal BP to the bypass transistor T7, a data line 171 intersecting the scan line 121 and transferring a data signal DSm, a driving voltage line 172 transferring a driving voltage ELVDD and formed so as to be substantially in parallel with the data line 171, and an initialization voltage line 192 transferring an initialization voltage Vint initializing the driving transistor T1.

A gate electrode G1 of the driving transistor T1 is connected to one end Cst1 of the storage capacitor Cst, a source electrode S1 of the driving transistor T1 is connected to the driving voltage line 172 through the operation control transistor T5, and a drain electrode D1 of the driving transistor T1 is electrically connected to an anode of the OLED through the light emission control transistor T6. The driving transistor T1 receives the data signal DSm depending on a switching operation of the switching transistor T2 and supplies a driving current $I_d$ to the OLED.

A gate electrode G2 of the switching transistor T2 is connected to the scan line 121, a source electrode S2 of the switching transistor T2 is connected to the data line 171, and a drain electrode D2 of the switching transistor T2 is connected to the source electrode S1 of the driving transistor T1 and is connected to the driving voltage line 172 through the operation control transistor T5. The switching transistor T2 performs a switching operation in which it is turned on depending on the scan signal SSn transferred through the scan line 121 to transfer to the data signal DSm transferred to the data line 171 to the source electrode of the driving transistor T1.

A gate electrode G3 of the compensation transistor T3 is connected to the scan line 121, and a source electrode S3 of the compensation transistor T3 is connected to the drain electrode D1 of the driving transistor T1 and is connected to the anode of the OLED through the light emission control transistor T6. And a drain electrode D3 of the compensation transistor T3 is corrected to all of a drain electrode D4 of the initialization transistor T4, one end Cst1 of the storage capacitor Cst, and the gate electrode G1 of the driving transistor T1. The compensation transistor T3 is turned on depending on the scan signal SSn transferred through the scan line 121 to connect the gate electrode G1 and the drain electrode D1 of the driving transistor T1 to each other, thereby connecting the driving transistor T1 in a diode form.

A gate electrode G4 of the initialization transistor T4 is connected to the front scan line 122, a source electrode S4 of the initialization transistor T4 is connected to the initialization voltage line 192, and the drain electrode D4 of the initialization transistor T4 is connected to both of one end Cst1 of the storage capacitor Cst and the gate electrode G1 of the driving transistor T1 through the drain electrode D3 of the compensation transistor T3. The initialization transistor T4 performs an initialization operation in which it is turned on depending on the front scan signal SSn-1 transferred through the front scan line 122 to transfer the initialization voltage Vint to the gate electrode G1 of the driving transistor T1, thereby initializing a gate voltage of the gate electrode G1 of the driving transistor T1.

A gate electrode G5 of the operation control transistor T5 is connected to the light emission control line 123, a source electrode S5 of the operation control transistor T5 is connected to the driving voltage line 172, and a drain electrode D5 of the operation control transistor T5 is connected to the source electrode S1 of the driving transistor T1 and the drain electrode S2 of the switching transistor T2.

A gate electrode G6 of the light emission control transistor T6 is connected to the light emission control line 123, a source electrode S6 of the light emission control transistor T6 is connected to the drain electrode D1 of the driving transistor T1 and the source electrode S3 of the compensation transistor T3, and a drain electrode D6 of the light emission control transistor T6 is electrically connected to the anode of the OLED. The operation control transistor T5 and the light emission control transistor T6 are substantially simultaneously (or concurrently) turned on depending on the light emission control signal EM transferred through the light emission control line 123, such that the driving voltage ELVDD is compensated for through the driving transistor T1 connected in the diode form and is transferred to the OLED.

A gate electrode G7 of the bypass transistor T7 is connected to the bypass control line 128, a source electrode S7 of the bypass transistor T7 is connected to both of the drain electrode D6 of the light emission control transistor T6 and the anode of the OLED, and a drain electrode D7 of the bypass transistor T7 is connected to both of the initialization voltage line 192 and the source electrode S4 of the initialization transistor T4.

The other end Cst2 of the storage capacitor Cst is connected to the driving voltage line 172, and a cathode of the OLED is connected to a common voltage line 741 transferring a common voltage ELVSS.

Next, a detailed operation process of one pixel of the OLED display according to an exemplary embodiment will be described in detail with reference to FIG. 3.

Figure 3:
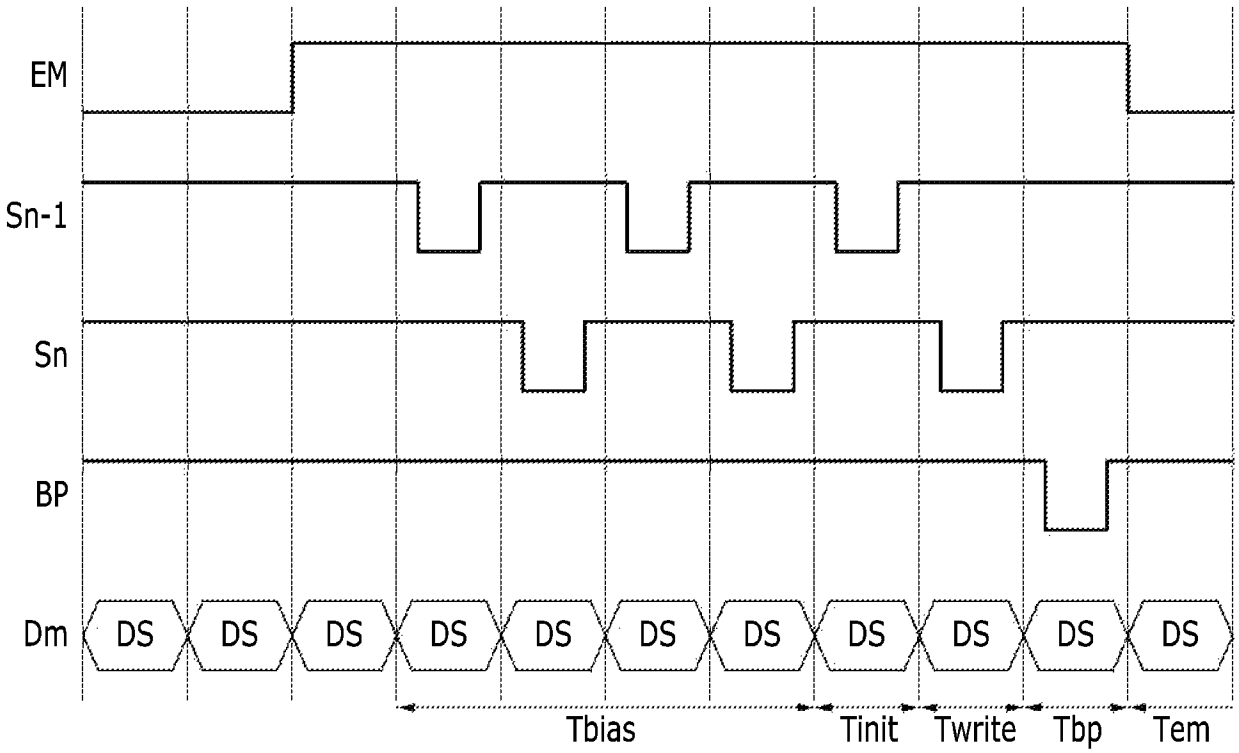
FIG. 3 is a timing diagram of a signal applied to one pixel of the OLED display according to an exemplary embodiment.

FIG. 3 is a timing diagram of a signal applied to one pixel of the OLED display according to an exemplary embodiment.

Referring to FIG. 3, a high-level light emission control signal EM is first supplied to the light emission control line 123, such that the operation control transistor T5 and the light emission control transistor T6 are turned off. When the operation control transistor T5 is turned off, the driving voltage ELVDD and the driving transistor T1 are electrically disconnected from each other. In addition, when the light emission control transistor T6 is turned off, the driving transistor T1 and the OLED are electrically disconnected from each other. That is, the pixel 1 is set to a non-light emission state during a period in which the high-level light emission control signal EM is supplied to the light emission control line 123.

Then, a low-level front scan signal SSn-1 and a low-level scan signal SSn are sequentially supplied to the front scan line 122 and the scan line 121 in a bias period Tbias.

When the low-level front scan signal SSn-1 is supplied to the front scan line 122, the initialization transistor T4 is turned on. When the initialization transistor T4 is turned on, the initialization voltage Vint supplied to the initialization voltage line 192 is supplied to the gate electrode G1 of the driving transistor T1 through the initialization transistor T4. Therefore, the gate electrode G1 of driving transistor T1 is set to the initialization voltage Vint lower than the data signal DSm.

When the low-level scan signal SSn is supplied to the scan line 121, the compensation transistor T3 and the switching transistor T2 are turned on. When the compensation transistor T3 is turned on, the driving transistor T1 is connected in a diode form, and when the switching transistor T2 is turned on, the data signal DSm applied to the data line 171 is supplied to the source electrode S1 of the driving transistor T1. The data signal DSm applied to the data line 171 in the bias period Tbias does not correspond to a data voltage for displaying an image, but corresponds to a bias voltage. A period in which the low-level scan signal SSn is supplied to the scan line 121, which corresponds to the bias period Tbias, overlaps a period in which the low-level scan signals SSn-1 and SSn-2 are supplied to the front scan line and a scan line in front of the front scan line, which corresponds to a data programming period. Therefore, the data signal DSm supplied in the bias period Tbias does not correspond to a data voltage that needs to be represented in a corresponding pixel 1, but can correspond to a data voltage that needs to be represented in the previous pixel row or a pixel row in front of the previous pixel row. The driving transistor T1 receives the bias voltage to enter a bias state, when the low-level scan signal SSn is supplied to the scan line 121 in the bias period Tbias. As described above, threshold voltage characteristics of the driving transistor T1 are initialized to a specific state during the bias period Tbias. Therefore, the OLED display 10 can display a substantially uniform image in the pixels PXs regardless of an image displayed in the previous frame period.

As described above, an operation of sequentially supplying the low-level front scan signal SSn-1 and the low-level scan signal SSn to initialize the driving transistor T1 to the on bias state can be performed once or more during the bias period Tbias. In an example of FIG. 3, the operation of sequentially supplying the low-level front scan signal SSn-1 and the low-level scan signal SSn to initialize the driving transistor T1 to the on bias state is repeated twice during the bias period Tbias.

The bias period Tbias is followed by an initialization period Tinit. In the initialization period Tinit, the low-level front scan signal SSn-1 is supplied, such that the initialization transistor T4 is turned on. Therefore, the initialization voltage Tint applied to the initialization voltage line 192 is supplied to the gate electrode G1 of the driving transistor T1 through the initialization transistor T4, such that the driving transistor T1 is initialized.

The initialization period Tinit is followed by a data programming period Tdata. In the data programming period Tdata, the low-level scan signal SSn is supplied through the scan line 121, such that the switching transistor T2 and the compensation transistor T3 are turned on. In this case, the driving transistor T1 is connected in the diode form by the turned-on compensation transistor T3, and is biased in a forward direction. In this case, a compensation voltage DSm+Vth (here, Vth is a negative value) decreased from the data signal DSm supplied from the data line 171 by a threshold voltage Vth of the driving transistor T1 is applied to the gate electrode G1 of the driving transistor T1. Therefore, the driving voltage ELVDD and the compensation voltage DSm+Vth are applied to both ends of the storage capacitor Cst, and electric charges corresponding to a voltage difference between both ends of the storage capacitor Cst are stored in the storage capacitor Cst. In the data programming period Tdata, the data signal for displaying the image is supplied to the data line 171.

Then, in a light emission period Tem, a level of the light emission control signal EM supplied from the light emission control line 123 is changed from a high level into a low level. In this case, the operation control transistor T5 and the light emission control transistor T6 are turned on by the low-level light emission control signal EM during the light emission period Tem. In this case, a driving current $I_d$ depending on a voltage difference between the gate voltage of the gate electrode G1 of the driving transistor T1 and the driving voltage ELVDD is generated, and is supplied to the OLED through the light emission control transistor T6. A gate-source voltage Vgs of the driving transistor T1 is maintained to be '(DSm+Vth)−ELVDD' by the storage capacitor Cst during the light emission period, and the driving current $I_d$ is substantially proportional to '$(DSm-ELVDD)^2$', which is a square of a value obtained by subtracting a threshold voltage from a source-gate voltage, according to a current-voltage relationship of the driving transistor T1. Therefore, the driving current $I_d$ is determined regardless of the threshold voltage Vth of the driving transistor T1.

In this case, the bypass transistor T7 receives the bypass signal BP from the bypass control line 128. The bypass signal (BP) is a predetermined-level voltage that can always turn off the bypass transistor T7, and the bypass transistor T7 receives a transistor turn-off level voltage at the gate electrode G7 thereof, such that the bypass transistor T7 is always turned off and some of the driving current $I_d$ exits as a bypass current $I_{bp}$ through the bypass transistor T7 in a state in which the bypass transistor T7 is turned off.

When the OLED emits light even in the case in which a minimum current of the driving transistor T1 displaying a black image flows as a driving current, the black image is not appropriately displayed. Therefore, the bypass transistor T7 of the OLED display according to an exemplary embodiment can disperse some of the minimum current of the driving transistor T1 as the bypass current $I_{bp}$ to a current path other than a current path toward the OLED. Here, the minimum current of the driving transistor T1 means a current in a condition in which the gate-source voltage Vgs of the driving transistor T1 is less than the threshold voltage Vth, such that the driving transistor T1 is turned off. The minimum driving current (for example, a current of about 10 pA or less) in the condition in which the driving transistor T1 is turned off is transferred to the OLED, such that an image having a black luminance is displayed. In the case in which the minimum driving current displaying the black image flows, an influence of a bypass transfer of the bypass current $I_{bp}$ is large. On the other hand, in the case in which a large driving current displaying an image such as a general image or a white image flows, an influence of the bypass current $I_{bp}$ can be hardly present. Therefore, in the case in which the driving current displaying the black image flows, a light emission current $I_{oled}$ of the OLED decreased from the driving current $I_d$ by an amount of the bypass current $I_{bp}$ exiting through the bypass transistor T7 has a minimum current amount, which is a level that can certainly display the black image. Therefore, an accurate black luminance image is implemented using the bypass transistor T7, thereby making it possible to improve a contrast ratio.

Although the pixel 1 having a 7-Tr 1-Cp structure including the bypass transistor T7 has been shown in an exemplary embodiment, the described technology is not limited thereto. That is, the numbers of transistors and capacitors configuring each pixel 1 can be variously changed.

Meanwhile, as described above, the bias period Tbias is added before the initialization period Tinit and the data programming period Tdata, such that low-level additional pulses are included in the scan signal SSn and the front scan signal SSn-1. Therefore, a phenomenon where a plurality of pixels PXs connected to the same data line share capacitances with each other is generated. This phenomenon as described above causes a problem where a horizontal line appears at a distal end of the display area DA due to a deviation of the shared capacitances.

Next, a horizontal line appearance phenomenon in the OLED display will be described in detail with reference to FIG. 4.

Figure 4:
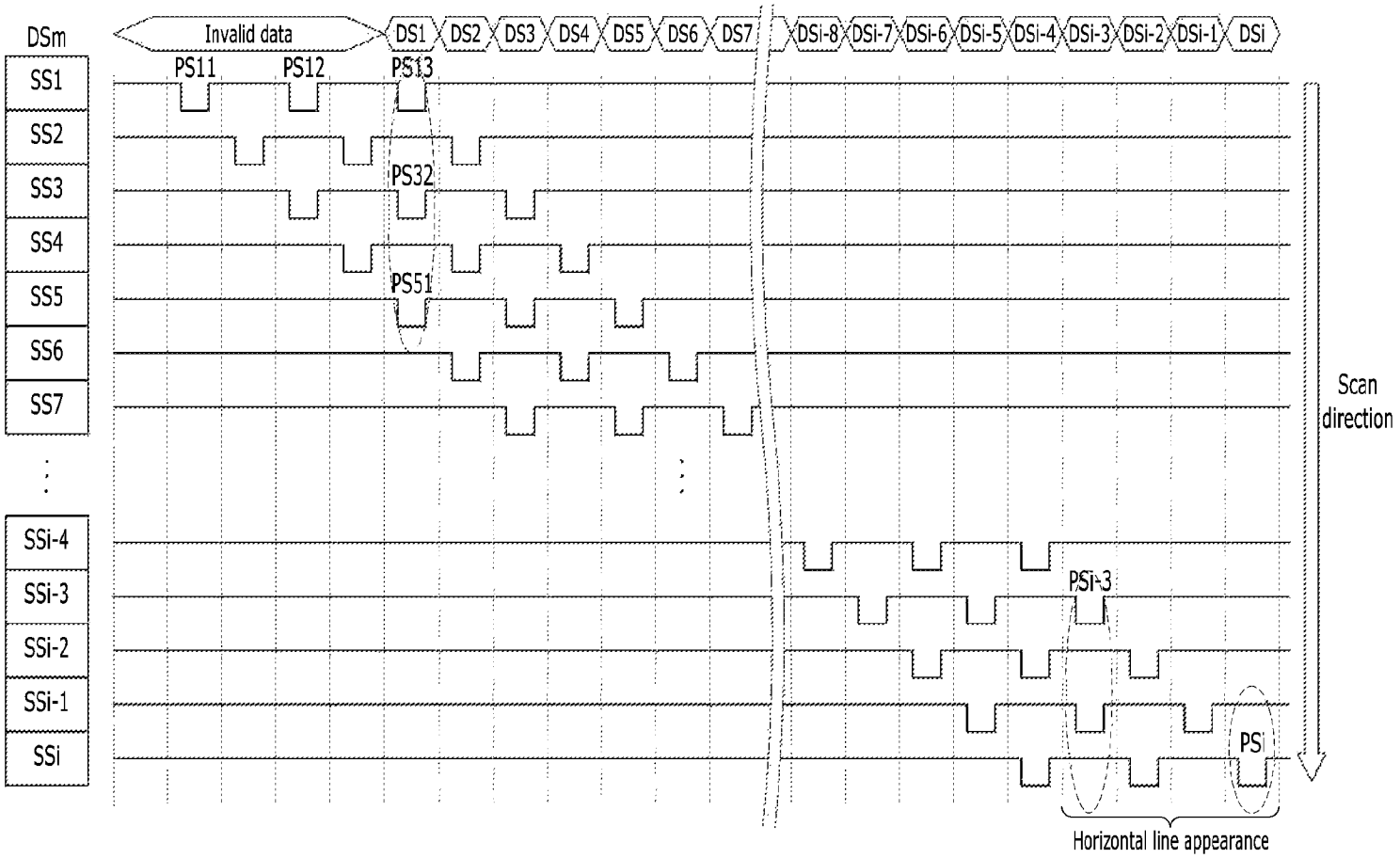
FIG. 4 is a view for describing a horizontal line appearance phenomenon in the OLED display.

FIG. 4 is a view for describing a horizontal line appearance phenomenon in the OLED display.

Referring to FIG. 4, scan signals SS1 to SSi output from the scan driver 120 to the respective pixel PX rows include two low-level pulses output in the bias period Tbias and one low-level pulse output in the data programming period Tdata. Describing a first scan signal SS1 by way of example, a first low-level pulse PS11 and a second low-level pulse PS12 of the first scan signal SS1 are pulses added corresponding to the bias period Tbias. A third low-level pulse PS13 of the first scan signal SS1 is a pulse output in the data programming period Tdata.

Meanwhile, due to the addition of the bias period Tbias, a period in which the low-level pulse PS13 of the data programming period Tdata is output in the first scan signal SS1 overlaps periods in which low-level pulses PS32 and PS51 are output in the bias period Tbias in other scan signals (third and fifth scan signals SS3 and SS5). Therefore, in a period Tdata in which a data signal DS1 is applied to a first pixel PX row connected to the first scan line SL1, switching transistors T2 of first, third, and fifth pixel PX rows connected to first, third, and fifth scan lines SL1, SL3 and SL5 are substantially simultaneously (or concurrently) turned on. In addition, in the first pixel PX row and the third and fifth pixel PX rows, a phenomenon where pixels PXs connected to the same data line share a capacitance with each other is generated. The capacitance sharing phenomenon as described above has an influence on electric charges stored in the storage capacitors Cst in the first pixel PX row.

As described above, the pulses for the bias are added, such that a phenomenon where different pixel PX rows share capacitances with each other is generated, and the capacitance sharing phenomenon as described above has an influence on luminances of the pixels PXs.

Meanwhile, since the number of pixel PX rows formed in the display panel 110 is determined, the number of pixel rows that can share the capacitances with each other in the data programming period Tdata is decreased from an i−3-th pixel PX row. Describing the i−3-th pixel PX row by way of example, a period in which a low-level pulse PSi-3 for data programming is output in a scan signal SSi-3 output to the i−3-th pixel PX row overlaps a period in which a low-level pulse PSi-1 for applying the bias voltage is output in an i−1-th scan signal SSi-1. Therefore, a pixel row with which the i−3-th pixel PX row can share a capacitance in the data programming period is only an i−1-th pixel PX row. In addition, describing an i-th pixel PX row by way of example, in a period in which a low-level pulse PSi for data programming is output in a scan signal SLi output to the i-th pixel PX row, a low-level pulse for applying the bias voltage is not output in other scan signals. Therefore, a pixel PX row with which the i-th pixel PX row can share the capacitance in the data programming period is not present.

As described above, the number of pixel rows that can share the capacitances with each other in the data programming period Tdata is decreased from the i−3-th pixel PX row, which generates luminance non-uniformity with pixel PX rows prior to the i−3-th pixel PX row, thereby allowing a horizontal line to appear at a distal end of the display area DA.

Therefore, in an exemplary embodiment, the dummy pixel DP rows are formed outside the display area DA, and the scan signals are output to the pixel PX rows and are then output to the dummy pixel DP rows, thereby solving non-uniformity of the shared capacitances.

Next, an operation process of the OLED display including the dummy pixel rows will be described in detail with reference to FIG. 5.

Figure 5:
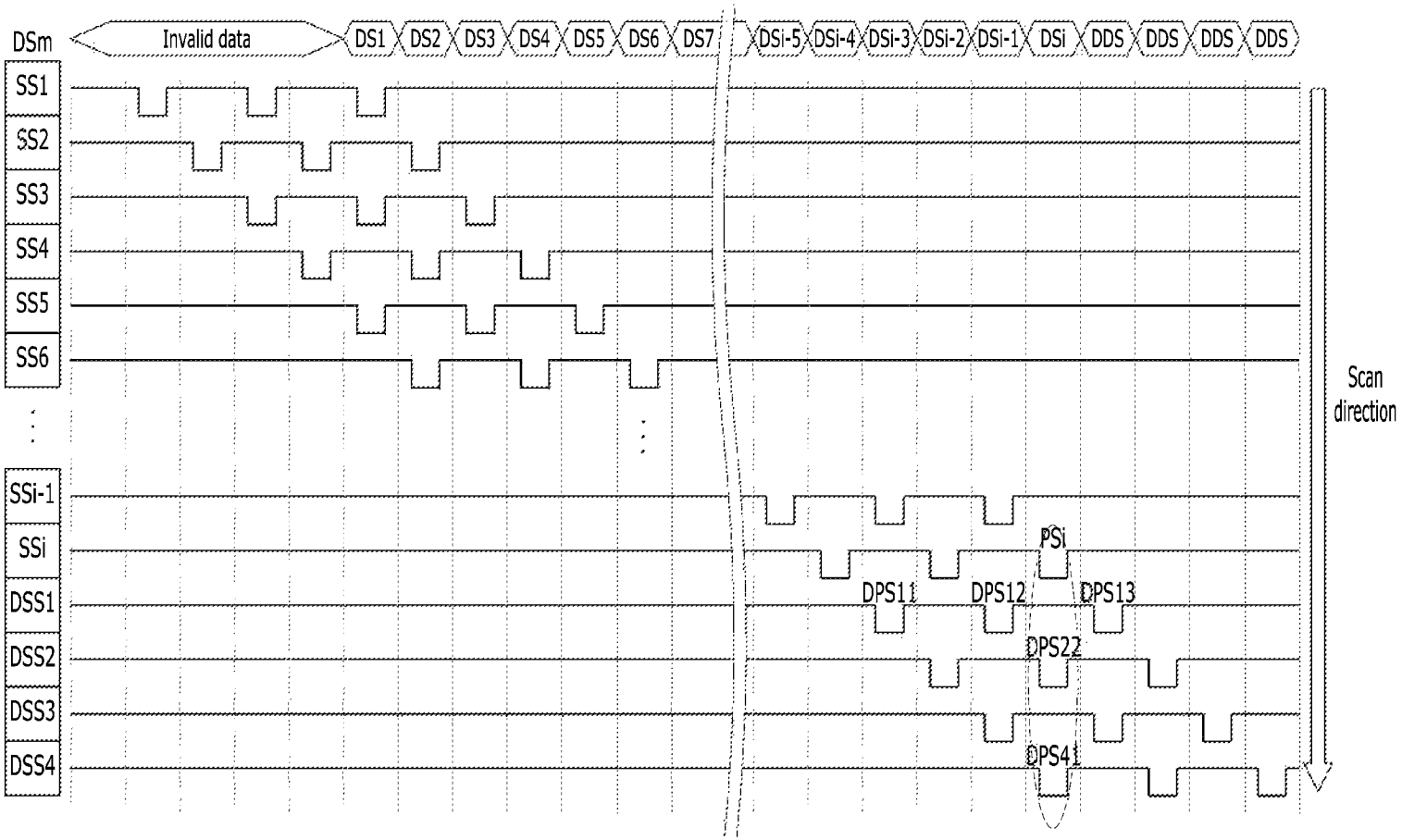
FIG. 5 is a view schematically showing operation timings in the OLED display according to an exemplary embodiment.

FIG. 5 is a view schematically showing operation timings in the OLED display according to an exemplary embodiment.

Referring to FIG. 5, dummy scan signals DSS1 to DSS4 output from the scan driver 120 to the respective dummy pixel DP rows include two low-level pulses output in the bias period Tbias and one low-level pulse output in the data programming period Tdata, similar to the scan signals SS1 to SSi output to the respective pixel PX rows. Describing a first dummy scan signal DSS1 by way of example, a first low-level pulse DPS11 and a second low-level pulse DPS12 of the first dummy scan signal DSS1 are pulses added for the purpose of the bias period Tbias, and a third low-level pulse DPS13 of the first dummy scan signal DSS1 is a pulse output in the data programming period Tdata.

As described above, the dummy pixel DP rows are added, and the scan signals are output to the pixel PX rows and are then output to the respective dummy pixel DP rows, thereby making shared capacitances in the data programming period Tdata substantially uniform up to a final pixel PX row, that is, the i-th pixel PX row, of the display panel 110.

Describing the i-th pixel PX row by way of example, a period in which a low-level pulse PSi of the data programming period Tdata is output in a scan signal SSi output to the i-th pixel PX row overlaps periods in which low-level pulses DPS22 and DPS41 for applying the bias voltage are output in scan signals DSS2 and DSS4 output to second and fourth dummy pixel DP rows. Therefore, in a period Tdata in which a data signal DSi is applied to the i-th pixel PX row, switching transistors T2 of the i-th pixel PX row and the second and fourth dummy pixel DP rows are substantially simultaneously (or concurrently) turned on. In addition, the respective pixels PXs configuring the i-th pixel PX row share capacitances with dummy pixels DPs configuring the second and fourth dummy pixel DP rows.

As described above, in an exemplary embodiment, the dummy pixels DP are formed to solve the non-uniformity of the shared capacitances, thereby making it possible to improve the horizontal line appearance phenomenon generated due to the addition of the pulses for applying the bias voltage.

Meanwhile, in the case in which the dummy pixel DP rows are added in order to improve the horizontal line appearance, a space in which the dummy pixels DPs are formed needs to be secured, such that a dead space, which is not the display area, is increased. For example, in the case in which the dummy pixel DP rows are formed at a time at the lower end (or the upper end) of the display area after the final pixel PX row depending a scan sequence, an area of the dead space is further increased.

Therefore, in an exemplary embodiment, a layout of the display panel 110 is desired so that the dummy pixel DP rows are formed at the upper end and the lower end of the display area in the state in which they are divided and the scan signals are output to the pixel PX rows and are then sequentially output to the dummy pixel DP rows, thereby making it possible to improve the horizontal line appearance phenomenon generated due to the addition of the pulses and minimize the increase in the dead space.

Meanwhile, the case in which the carry out line COL connecting between the dummy stages formed at the upper end and the lower end of the display area DA so as to be spaced apart from each other is formed so that the dummy stages DSRC1 to DSRC4 supplying the scan signals to the dummy pixel DP rows formed at the upper end and the lower end of the display area DA are sequentially driven has been shown by way of example in FIG. 1, an exemplary embodiment is not limited thereto.

Figure 6:
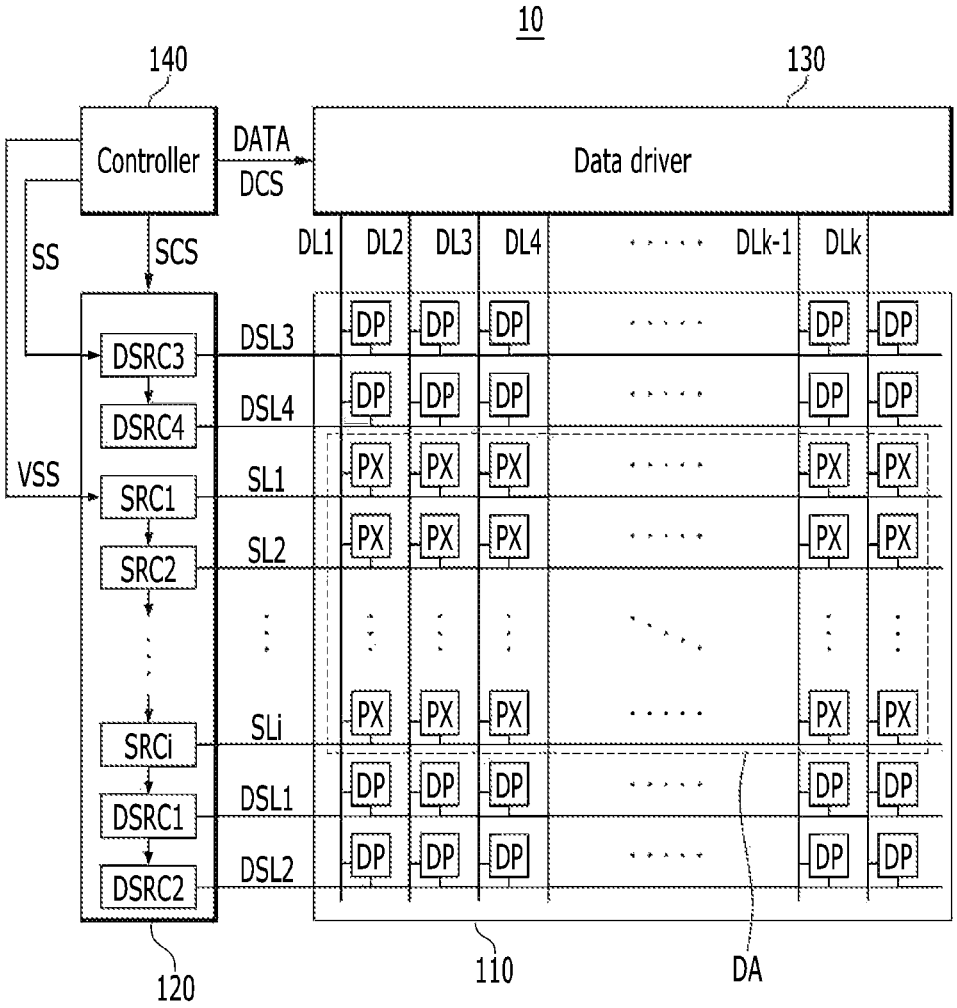
FIG. 6 is a schematic block diagram of an OLED display according to another exemplary embodiment.

In an OLED display according to another exemplary embodiment, as shown in FIG. 6, a start signal SS for starting to drive the dummy stages DSR3 and DSR4 positioned at the upper end (or the lower end) of the display area DA can also be input from the controller 140.

While the inventive technology has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. An organic light-emitting diode (OLED) display, comprising:

a display panel including a plurality of display pixels formed at intersection areas of a plurality of scan lines and a plurality of data lines and a plurality of dummy pixels formed at intersection areas of a plurality of dummy scan lines and the data lines;

a scan driver including a plurality of first stages configured to sequentially supply a plurality of scan signals to the scan lines and a plurality of second stages configured to sequentially supply a plurality of scan signals to the dummy scan lines; and a data driver configured to provide corresponding data signals to the data lines, wherein each of the scan signals includes at least one first pulse to be applied as a bias voltage to a driving transistor of each of the display pixels and the dummy pixels and a second pulse to be applied as the corresponding data signal to the driving transistor, and wherein a period in which the first pulse is output to one of the dummy scan lines overlaps a period in which the second pulse is output to one of the scan lines.

2. The OLED display of claim 1, wherein the second stages are electrically connected to the first stages and configured to sequentially supply the scan signals to the respective dummy scan lines after the first stages supply the scan signals.

3. The OLED display of claim 2, wherein the first stages comprise a final stage configured to drive a first one of the second stages.

4. The OLED display of claim 2, wherein the dummy pixels are formed above and below the display pixels in the display panel, and wherein the second stages include first and second stage groups formed above and below the first stages.

5. The OLED display of claim 4, wherein the display panel includes at least one carry out line electrically connected to the first and second stage groups.

6. The OLED display of claim 4, further comprising a controller configured to generate a scan control signal to control the scan driver and a data control signal to control the data driver.

7. The OLED display of claim 6, wherein any one of the first and second stage groups is configured to receive a start signal input from the controller.

8. The OLED display of claim 1, wherein a first group of the display pixels connected to the first scan line share capacitances with a second group of the display pixels connected to the at least one of the other scan lines in the period in which the second pulse is output to the first scan line.

9. The OLED display of claim 1, wherein each of the display pixels includes:

a switching transistor electrically connected to a corresponding scan line and a corresponding data line and including a drain electrode configured to output the bias voltage during a period in which the first pulse is input to the corresponding scan line and output a corresponding data signal during a period in which the second pulse is input to the corresponding scan line;

the driving transistor including a source electrode electrically connected to the drain electrode of the switching transistor;

a storage capacitor including a first electrode electrically connected to a gate electrode of the driving transistor and a second electrode electrically connected to a driving voltage line to which a driving voltage is input; and an OLED electrically connected to the drain electrode of the driving transistor.

10. An organic light-emitting diode (OLED) display, comprising:

a display panel including a plurality of display pixels arranged in a plurality of rows and a plurality of dummy pixels arranged in a plurality of rows; and a scan driver including a plurality of first stages configured to sequentially supply a plurality of scan signals to a plurality of scan lines and a plurality of second stages formed above and below the first stages and configured to sequentially supply a plurality of scan signals to dummy scan lines, wherein each of the scan signals includes at least one first pulse configured to be applied as a bias voltage to the display pixels and the dummy pixels and a second pulse configured to be applied as a data signal to the display and dummy pixels, wherein a period in which the first pulse is output to one of the dummy scan lines overlaps a period in which the second pulse is output to one of the scan lines.

11. The OLED display of claim 10, wherein the scan driver has an upper side and a lower side, and wherein the second stages include a plurality of upper second stages formed in the upper side and a plurality of lower second stages formed in the lower side.

12. The OLED display of claim 11, wherein the dummy pixels are formed above and below the display pixels in the display panel, wherein the upper second stages are formed above the first stages, and wherein the lower second stages are formed below the first stages.

13. The OLED display of claim 12, wherein the upper second stages include two stages, and wherein the lower second stages include two stages.

14. The OLED display of claim 12, further comprising a controller configured to provide a scan control signal to the scan driver and a scan start signal to the upper second stages.

15. The OLED display of claim 14, wherein the controller is further configured to provide a vertical start signal to start a scanning process only for the first one of the first stages.

16. The OLED display of claim 12, wherein the lower second stages are configured to provide a carry out signal to the upper second stages.

17. The OLED display of claim 16, wherein the scan lines include first to last scan lines, and wherein a last one of the first stages is configured to provide two bias voltage pulses to the last scan line and a data voltage.

18. The OLED display of claim 17, wherein a last one of the second stages is configured to provide two bias voltages and a data voltage to a last one of the dummy scan lines, and wherein the time when the data voltage is provided to the last first stage overlaps the time when the first one of the bias voltages is applied to the last dummy scan line.

19. The OLED display of claim 18, wherein each of the display and dummy pixels includes driving, switching and compensation transistors each including a gate electrode connected to the corresponding scan line or dummy scan line.

* * * * *